US008923717B2

(12) United States Patent
Izumi et al.

(10) Patent No.: US 8,923,717 B2
(45) Date of Patent: Dec. 30, 2014

(54) TRANSFER DEVICE HAVING A PLURALITY OF PRIMARY TRANSFER ROLLERS

(75) Inventors: Hideshi Izumi, Osaka (JP); Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 188 days.

(21) Appl. No.: 13/588,044

(22) Filed: Aug. 17, 2012

(65) Prior Publication Data

US 2013/0061698 A1 Mar. 14, 2013

(30) Foreign Application Priority Data

Sep. 12, 2011 (JP) ..... 2011-197800

(51) Int. Cl.
*G03G 15/16* (2006.01)
*G03G 15/01* (2006.01)

(52) U.S. Cl.
CPC .... *G03G 15/0189* (2013.01); *G03G 2215/0132* (2013.01); *G03G 2215/0193* (2013.01); *G03G 15/0136* (2013.01)
USPC ..... 399/66; 399/302

(58) Field of Classification Search
USPC ..... 399/66, 302
See application file for complete search history.

(56) References Cited

U.S. PATENT DOCUMENTS

| | | | | |
|---|---|---|---|---|
| 7,333,759 | B2 * | 2/2008 | Kaiho | 399/302 |
| 2007/0196141 | A1 | 8/2007 | Kitagawa et al. | |
| 2012/0003006 | A1 * | 1/2012 | Tachiki | 399/302 |
| 2013/0322934 | A1 * | 12/2013 | Hatano | 399/302 |

FOREIGN PATENT DOCUMENTS

| | | | |
|---|---|---|---|
| JP | 2007-219419 | A | 8/2007 |
| JP | 2010-134149 | A | 6/2010 |
| JP | 2011-185987 | A | 9/2011 |

* cited by examiner

*Primary Examiner* — David Gray
*Assistant Examiner* — Laura Roth
(74) *Attorney, Agent, or Firm* — Renner, Otto, Boisselle & Sklar, LLP

(57) ABSTRACT

A transfer device includes a plurality of primary transfer rollers, a second link member and a regulatory member. The regulatory member restrains the second link member from moving further than a predetermined position toward the second direction. The second link member causes the primary transfer rollers to be displaced as it moves. The second link member is split into a plurality of link arms of which overall length is variable within a predetermined range; and its joint portion includes an elastic member urging the plurality of link arms toward a direction to which the overall length gets longer in a state where the second link member is most separate from a cam shaft, and a first locking section and a second locking section engaging the plurality of link arms with one another for the overall length not to get longer beyond a maximum value.

4 Claims, 8 Drawing Sheets

TRANSFER DEVICE HAVING A PLURALITY OF PRIMARY TRANSFER ROLLERS

CROSS REFERENCE

This Nonprovisional application claims priority under 35 U.S.C. §119(a) on Patent Application No. 2011-197800 filed in Japan on Sep. 12, 2011, the entire contents of which are hereby incorporated by reference.

BACKGROUND OF THE INVENTION

The present invention relates to a transfer device that transfers a toner image from a plurality of image bearing members to paper through an intermediate transfer belt.

Among the image forming apparatus adopting the electrophotography method is one equipped with a transfer device that is based on the intermediate transfer method in which toner images are transferred in such a manner as to be superimposed sequentially from a plurality of image bearing members onto an intermediate transfer belt in the primary transfer and then the toner image is transferred from the intermediate transfer belt onto paper in the secondary transfer.

In the transfer device that is based on the intermediate transfer method and is installed in a color image forming apparatus, the intermediate transfer belt is caused to be displaced depending on its operational modes, that is to say, monochromatic image forming mode, color image forming mode and standby mode. The intermediate transfer belt comes into contact with only an image bearing member for black in the monochromatic image forming mode, comes into contact with all the image bearing members in the color image forming mode, and is separate from all the image bearing members in the standby mode.

For example, as disclosed in Japanese Patent Unexamined Publication No. 2010-134149 bulletin, transition between the intermediate transfer belt's contact with and separation from the image bearing members is achieved by causing the plurality of primary transfer rollers opposed to the plurality of image bearing members across the intermediate transfer belt to be displaced.

The conventional transfer device as described in the Patent Document above includes a link member for black to cause the primary transfer roller for black to be displaced, a link member for color to cause the primary transfer rollers for color to be displaced, cams to cause the link member for black and the link member for color to respectively move and a drive source to rotate the cams. A longitudinal movement of the link member for black causes the primary transfer roller for black to be displaced toward contact-separation directions in relation to the image bearing member for black, and a longitudinal movement of the link members for color causes the primary transfer rollers for color to be displaced toward contact-separation directions in relation to the image bearing members for color.

Even when a resin material such as POM (polyoxymethylene) resin or the like is used for the link member for black for reasons such as improved sliding property with the cam and prevention of electric leakage etc., a thermally induced dimensional change of the link member for black is small because the link member for black is shorter as compared with the link member for color. As a result, a displacement error due to a temperature change is relatively small in the case of the primary transfer roller for black; therefore, movement of the intermediate transfer belt's contact with and separation from the image bearing member is operable rather steadily.

Whereas, the thermally induced dimensional change of the link member for color amounts to big because it is longer as compared with the link member for black so as to cause the plurality of primary transfer rollers to be displaced. For example, with a 240 mm long link member for color formed using the POM resin, when a temperature range of 5-45 degrees Celsius as an internal temperature of the image forming apparatus and an occurrence of a temperature change of 10 degrees Celsius are assumed, a thermally induced dimensional change of +−0.3 mm is expected to occur. If a temperature change of 30 degrees Celsius occurs, the thermally induced dimensional change amounts to an extent as big as 1 mm.

Accordingly, accuracy in an arrangement of the primary transfer rollers for color that are linked to the movement of the link member for color deteriorates due to the change of the internal temperature of the image forming apparatus. As a result, the movement of the intermediate transfer belt's contact with and separation from the image bearing members for color becomes unsteady; so that picture quality is prone to deteriorate. Among the primary transfer rollers for color, a primary transfer roller joined to the other end portion on the opposite side of an end portion on the side that is in contact with the cam of the link member for color with pressure is most subject to harmful effect resulting from the thermally induced dimensional change of the link member for color, so that accuracy in its arrangement is more liable to deteriorate.

For example, because a contact pressure of an intermediate transfer belt against the image bearing members for color becomes too strong when the link member for color elongates due to the thermally induced dimensional change, problems such as deterioration of picture quality and shortening of life cycle due to abrasion of the image bearing members for color and the intermediate transfer belt can occur.

Further, when the link member for color becomes shortened due to its thermal shrinkage, there arises a risk that the intermediate transfer belt will not come into contact with the image bearing members for color; so that the problem of picture quality deterioration can occur.

The present invention is directed to providing a transfer device capable of suppressing the deterioration of accuracy in an arrangement of primary transfer rollers due to a thermally induced dimensional change of a link member.

SUMMARY OF THE INVENTION

A transfer device according to the present invention is one installed in an image forming apparatus transferring toner images from a plurality of image bearing members onto paper through an intermediate transfer belt, and the device comprises a plurality of primary transfer rollers that are disposed opposed to the plurality of image bearing members across the intermediate transfer belt and are capable of displacement toward contact-separation directions in relation to the respective plurality of image bearing members. The transfer device comprises a cam, a link member and a regulatory member. The cam, receiving transmission of power, revolves around a cam shaft. The link member, while being in contact with the cam with pressure, is movable within a predetermined range in a first direction toward the cam shaft's side and in a second direction that is the opposite direction of the first direction, and its movement toward the first direction and the second direction causes at least one of the primary transfer rollers to be displaced toward contact-separation directions. The regulatory member restrains the link member from moving further than a predetermined position toward the second direction. The link member is split into a plurality of link arms along the first direction with each joint portion of two adjacent link arms being configured in such a manner that an overall length of the two adjacent link arms is variable within a predetermined range that is not less than a predetermined minimum value and not greater than a predetermined maximum value, where each of the joint portions includes an elastic member urging the two adjacent link arms toward a direction to which the overall length gets longer in a state in which the cam has revolved to a separation angle at which the link member is caused to be most separate from the cam shaft and an engagement mechanism that engages the two adjacent link arms with each other in order for the overall length not to get longer beyond the maximum value, and where the overall length in the state in which the cam has revolved to the separation angle takes a value other than the minimum value and the maximum value.

In this configuration, the link member moves with its cam's side end portion in contact with the cam with pressure functioning as a point of reference for positioning. Besides, after the link member comes into contact with the regulatory member when it moves toward the second direction, the regulatory member's side end portion on the opposite side of the cam's side end portion also functions as a point of reference for positioning. After the regulatory member's side end portion comes into contact with the regulatory member, the overall length of the two adjacent link arms shortens resisting the urging force of the elastic member as the link member moves toward the second direction. In the state where the cam has revolved to the separation angle at which the link member is caused to be most separate from the cam shaft, the overall length of the two adjacent link arms takes a value other than the minimum value and the maximum value. As a result, even when the link member is subjected to thermal expansion or thermal shrinkage, influence of such thermally induced dimensional change on the link member is absorbed by the elastic member, thereby maintaining a position of regulatory member's side end portion in the state where the cam has revolved to the separation angle at a position of contact with the regulatory member, i.e., a constant position, regardless of a thermally induced dimensional change of the link member. In this manner, both of the cam's side end portion and the regulatory member's side end portion of the link member function as points of reference for positioning. Accordingly, deterioration of accuracy in an arrangement of the primary transfer rollers is suppressed.

As a result, even when the link member is subjected to thermal expansion, the contact pressure of the intermediate transfer belt against the image bearing members is prevented from becoming too strong. Additionally, even when the link member is subjected to thermal shrinkage, a situation in which the intermediate transfer belt will not come into contact with the image bearing member is prevented from occurring.

The present invention allows for suppressing deterioration of accuracy in an arrangement of primary transfer rollers due to a thermally induced dimensional change of a link member.

DETAILED DESCRIPTION OF THE INVENTION

Figure 1:
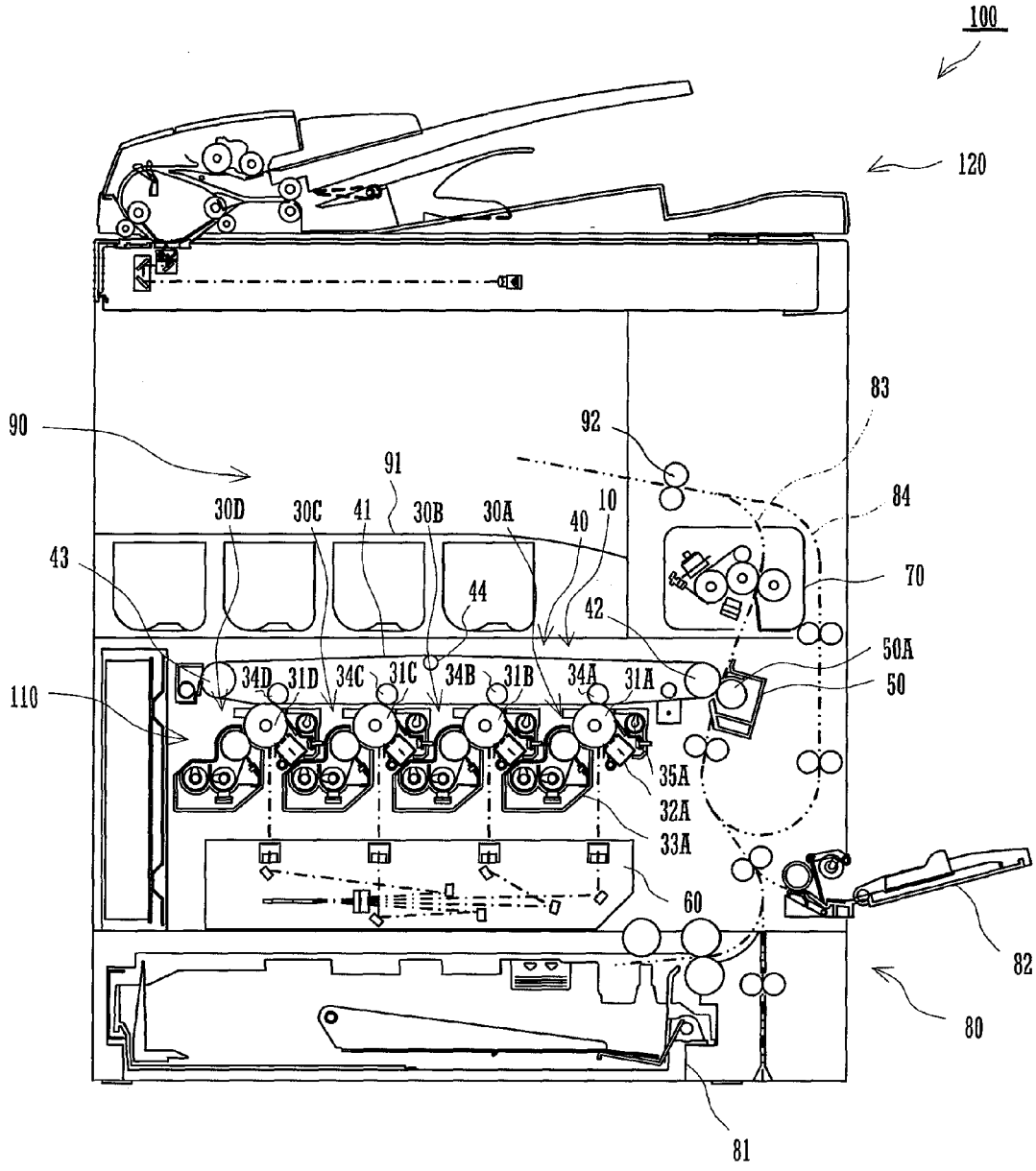
FIG. 1 is a general front sectional view of an image forming apparatus provided with a transfer device according to an embodiment of the present invention.

An image forming apparatus 100 that is provided with a transfer device 10 according to an embodiment of the present invention is explained below, referring to the drawings.

As shown in FIG. 1, the image forming apparatus 100 forms a multicolored or a monochromatic image onto a predetermined sheet of paper based on image data that have been read from a document. As for the paper, normal paper, thick paper, photographic paper, and sheet recording medium such as OHP film can be exemplified. The image forming apparatus 100 is provided with an image reading unit 120 in the upper part of a main body, and is also provided with an image forming section 110 and a paper feeding section 80 in the main body.

The image reading unit 120 projects a light on an image plane of the document, and detects the light quantity of a reflected light, thereby producing the image data.

The image forming section 110 is provided with an intermediate transfer unit 40, image forming stations 30A, 30B, 30C, 30D, a secondary transfer unit 50, an exposure unit 60 and a fuser unit 70.

The intermediate transfer unit 40 includes an intermediate transfer belt 41 which is an endless belt, a first tension roller 42, a second tension roller 43 and a tension roller 44. The intermediate transfer belt 41 is passed over the first tension roller 42, the second tension roller 43 and the tension roller 44 and tensioned therewith. As an example, the first tension roller 42 is a drive roller, and the second tension roller 43 is an idle roller. The tension roller 44 adjusts the tensile force of the intermediate transfer belt 41.

The image forming stations 30A through 30D each perform an image forming process according to the electrophotography method using toners of respective hues consisting of black, cyan, magenta and yellow. The image forming stations 30A through 30D are aligned to each other so as to face a predetermined region of the intermediate transfer belt 41. The image forming stations 30B through 30D are configured in the same manner as the image forming station 30A.

The image forming station 30A is provided with a photoreceptor drum for monochrome 31A that bears black toner. The image forming stations 30B, 30C, 30D are respectively provided with photoreceptor drums for color 31B, 31C, 31D that bear each toner for color. The photoreceptor drums 31A through 31D each constitute an image bearing member.

The image forming station 30A has, around the photoreceptor drum 31A, an electrostatic charger 32A, a developing device 33A, a primary transfer roller 34A and a cleaning device 35A. Similarly, the image forming stations 30B, 30C, 30D have primary transfer rollers 34B, 34C, 34D, respectively.

The photoreceptor drum 31A is caused to rotate in a predetermined direction by a driving force transmitted from a drive source not illustrated. The electrostatic charger 32A charges a circumferential surface of the photoreceptor drum 31A to a predetermined electrostatic potential.

The exposure unit 60 drives a semiconductor laser based on the image data on the respective hues consisting of black, cyan, magenta and yellow, and distributes laser beams for the respective hues onto the respective photoreceptor drums 31A through 31D of the image forming stations 30A through 30D. On the circumferential surfaces of the photoreceptor drums 31A through 31D are formed electrostatic latent images based on the image data on the respective hues consisting of black, cyan, magenta and yellow.

The developing device 33A supplies the circumferential surface of the photoreceptor drum 31A with the black toner which is the hue for the image forming station 30A, thereby rendering the electrostatic latent image visible in a black toner image.

An outer circumferential surface of the intermediate transfer belt 41 sequentially faces the photoreceptor drums 31A through 31D. The primary transfer roller 34A is disposed at a position opposed to the photoreceptor drum 31A across the intermediate transfer belt 41. The primary transfer roller 34B is disposed at a position opposed to the photoreceptor drum 31B across the intermediate transfer belt 41. The primary transfer roller 34C is disposed at a position opposed to the photoreceptor drum 31C across the intermediate transfer belt 41. The primary transfer roller 34D is disposed at a position opposed to the photoreceptor drum 31D across the intermediate transfer belt 41.

With an applied primary transfer bias of a polarity (for instance, plus) reverse to the electrostatic charge polarity (for instance, minus) of the toner, the primary transfer roller 34A carries out a primary transfer of the toner image borne on the photoreceptor drum 31A onto the outer circumferential surface of the intermediate transfer belt 41. The intermediate transfer unit 40 and the primary transfer rollers 34A through 34D are included in the transfer device 10.

The toner remaining on the outer circumferential surface of the photoreceptor drum 31A is removed by the cleaning device 35A.

In monochromatic image forming, the above mentioned image forming process is performed only at the image forming station for monochrome 30A. Then, in full-color image forming, image forming processes similar to that at the image forming station 30A are also performed on the respective hues of cyan, magenta and yellow at the image forming stations 30B through 30D, in addition to the image forming station 30A. With the primary transfer bias(es) applied to the respective primary transfer rollers 34A through 34D of the image forming stations 30A thorough 30D, the toner images of the respective hues consisting of black, cyan, magenta and yellow are transferred sequentially in such a manner as to be superimposed to a single image on the outer circumferential surface of the intermediate transfer belt 41.

The paper feeding section 80 includes a paper feed cassette 81, a hand-fed paper tray 82, a main paper conveying path 83 and a secondary paper conveying path 84. In the paper feed cassette 81 are received a plurality of paper sheets of size and kind with a relatively high frequency in use. Onto the hand-fed paper tray 82 is placed paper sheet(s) of size and kind with a relatively low frequency in use.

The main paper conveying path 83 is configured so as to reach a paper discharge section 90 from the paper feed cassette 81 and the hand-fed paper tray 82, passing a space between the intermediate transfer belt 41 and the secondary transfer unit 50, and then via the fuser unit 70. The secondary paper conveying path 84, which is a paper conveying path for duplex printing, is configured in such a manner that a paper sheet on which face on one side an image forming has been performed is conveyed, with faces on both sides thereof turned, again to the space between the intermediate transfer belt 41 and the secondary transfer unit 50.

The secondary transfer unit 50 has a secondary transfer roller 50A. With a secondary transfer bias of a polarity (for instance, plus) reverse to the electrostatic charge polarity (for instance, minus) of the toner being applied to the secondary transfer roller 50A, the toner image borne on the outer circumferential surface of the intermediate transfer belt 41 is transferred to the paper sheet. The secondary transfer unit 50 is included in the transfer device 10.

The fuser unit 70 fixes the toner image on the paper sheet by heating and pressing the paper sheet onto which the toner image has been transferred.

The paper discharge section 90 includes a paper receiving tray 91 and a paper discharge roller 92. The paper sheet on which the toner image has been fixed is discharged to the paper receiving tray 91 by the paper discharge roller 92. The paper sheet is received in the paper receiving tray 91 with the face on which the toner image has been fixed facing down.

Figure 2A:
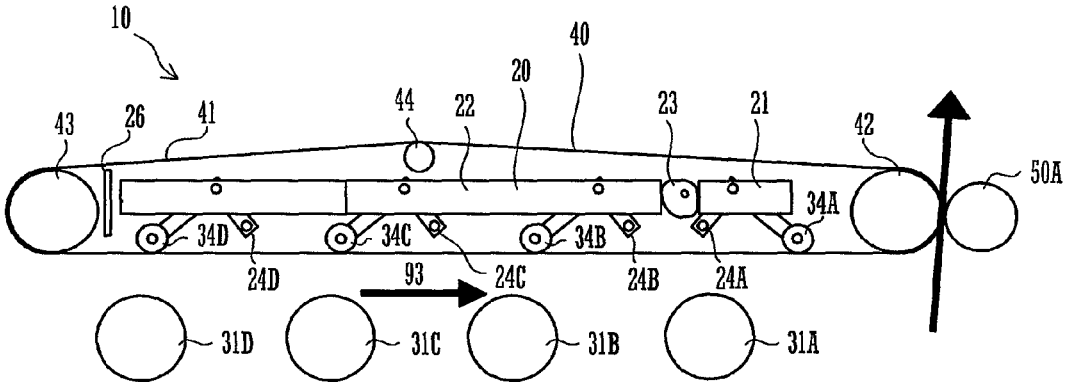
FIG. 2A through FIG. 2C are front views showing a general configuration of the transfer device, with FIG. 2A showing a state thereof in non-image forming, FIG. 2B showing a state thereof in monochromatic image forming, and FIG. 2C showing a state thereof in full-color image forming.
Figure 2B:
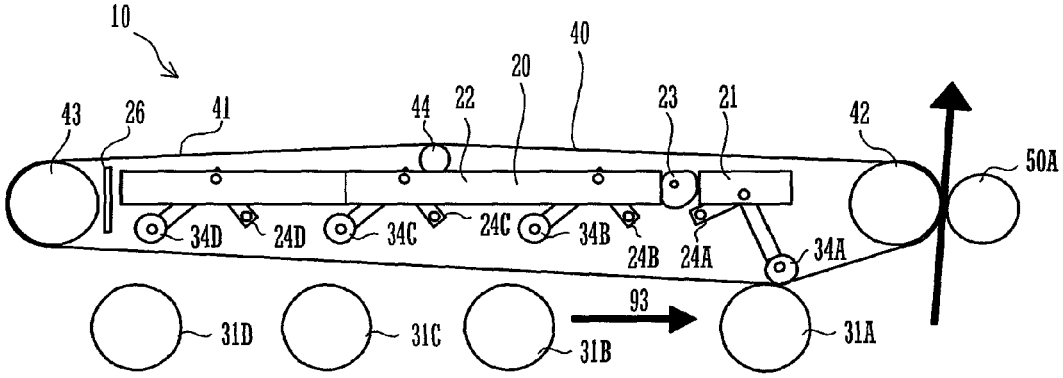
Figure 2C:
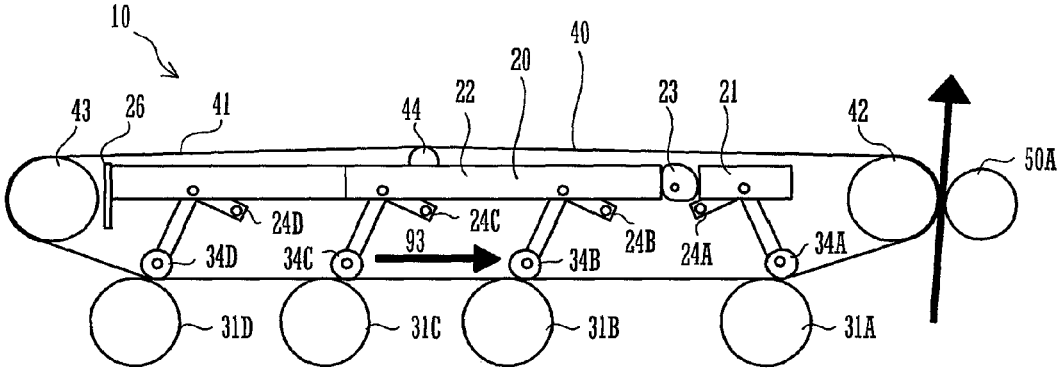

Subsequently, a configuration of the transfer device 10 is explained. As shown in FIG. 2A through FIG. 2C, the intermediate transfer belt 41 is passed over between the first tension roller and the second tension roller 43 and tensioned therewith, thereby forming a predetermined loop-like path of its movement. Along the outer circumferential surface of the intermediate transfer belt 41 in the region facing the photoreceptor drums 31A through 31D, the photoreceptor drum 31D, the photoreceptor drum 31C, the photoreceptor drum 31B and the photoreceptor drum 31A are disposed in this order from the upstream side in a direction of movement 93 of the intermediate transfer belt 41. In the direction of movement 93, the first tension roller 42 is disposed on the downstream side, and the second tension roller 43 is disposed on the upstream side. As described above, the primary transfer rollers 34A through 34D are disposed at positions opposed to the respective photoreceptor drums 31A through 31D across the intermediate transfer belt 41. In the embodiment, the intermediate transfer belt 41 is disposed above the photoreceptor drums 31A through 31D.

Figure 3A:
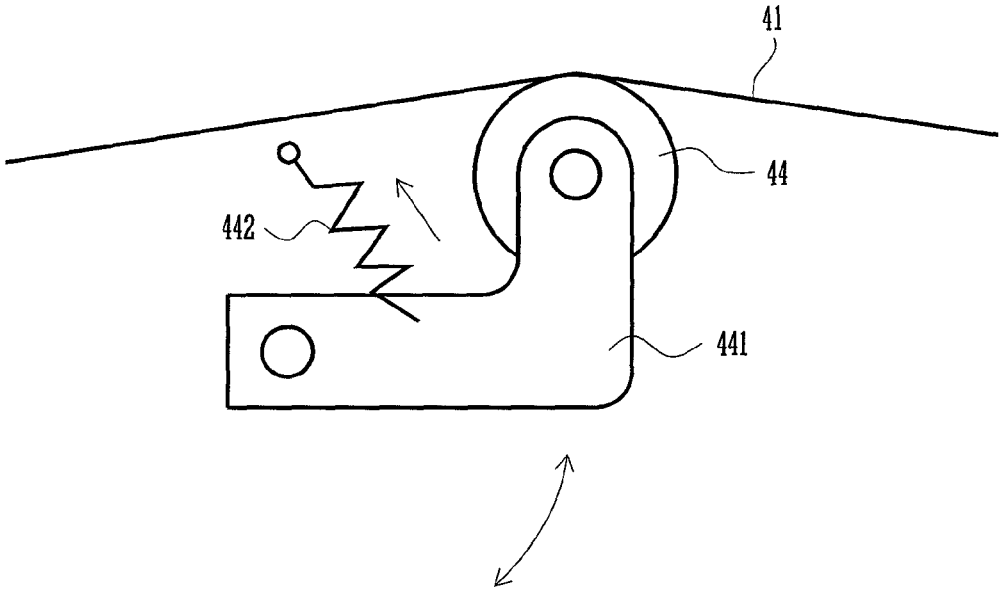
FIG. 3A is a drawings showing a configuration of a tension roller.

As shown in FIG. 3A, the tension roller 44 is in contact with the inner circumferential surface of the intermediate transfer belt 41 with pressure. The tension roller 44 is supported rotatably by a tip portion of the arm 441. Root edge portion of the arm 441 is supported rotatably by a frame (not shown) of the intermediate transfer unit 40. The arm 441 is urged by a spring 442 toward a direction where the tension roller 44 is caused to come into contact with the inner circumferential surface of the intermediate transfer belt 41 with pressure. This allows the intermediate transfer belt 41 to be held at a constant tensile force throughout the time in non-image forming, in monochromatic image forming, and in full-color image forming.

The primary transfer rollers 34A through 34D are configured so as to be capable of displacement toward contact-separation directions in relation to the respectively facing photoreceptor drums 31A through 31D. This configuration allows the primary transfer roller 34A to be capable of displacement at least between a pressing position where the intermediate transfer belt 41 is caused to be pressed against the facing photoreceptor drum 31A and a separate position where the intermediate transfer belt 41 is caused to be separate from the facing photoreceptor drum 31A. The same manner applies to the primary transfer rollers 34B through 34D as to the primary transfer roller 34A.

As shown in FIG. 2A, in non-image forming, all of the primary transfer rollers 34A through 34D are disposed at the respective separate positions, thereby causing the intermediate transfer belt 41 to be separate from the photoreceptor drums 31A through 31D.

As shown in FIG. 2B, in monochromatic image forming, the primary transfer roller for monochrome 34A is disposed at the pressing position, thereby causing the intermediate transfer belt 41 to be pressed against the photoreceptor drum 31A with pressure. On the other hand, the primary transfer rollers for color 34B through 34D are disposed at the respective separate positions, thereby causing the intermediate transfer belt 41 to be separate from the photoreceptor drums 31B through 31D.

As shown in FIG. 2C, in full-color image forming, all of the primary transfer rollers 34A through 34D are disposed at the respective pressing positions, thereby causing the intermediate transfer belt 41 to be pressed against the photoreceptor drums 31A through 31D with pressure.

Displacements of the primary transfer rollers 34A through 34D toward the contact-separation directions are performed by a transfer member moving mechanism 20.

The transfer member moving mechanism 20 includes a first link member 21, a second link member 22, a cam 23, and a first to fourth swinging members 24A, 24B, 24C, 24D.

Along the direction of movement 93 of the intermediate transfer belt 41, the cam 23 is disposed between the first link member 21 and the second link member 22. The first link member 21 and the second link member 22 are disposed such that longitudinal direction thereof becomes parallel to the direction of movement 93, and are movable within a predetermined range along the direction of movement 93. The first link member 21 and the second link member 22 are respectively urged toward the cam 23, and are in contact with the cam 23 with pressure.

Figure 4:
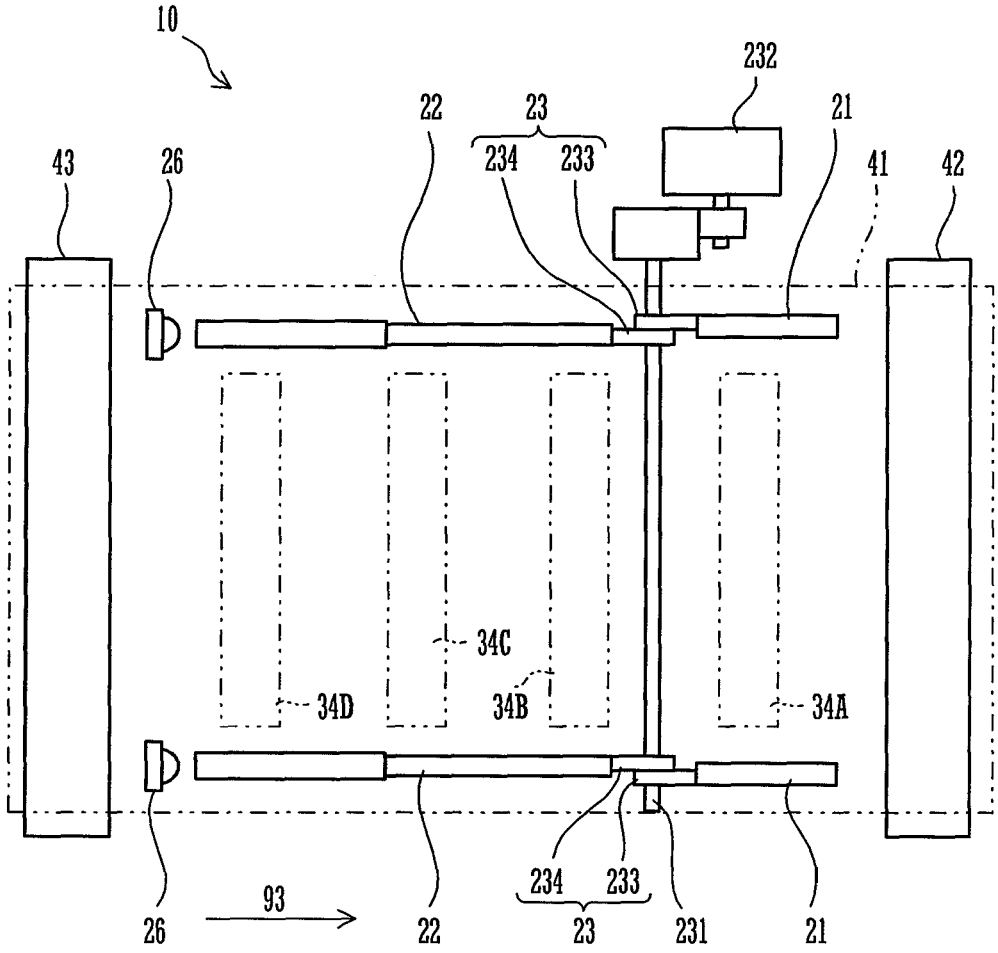
FIG. 4 is a general top view of the transfer device.

As shown in FIG. 4, the first link member 21, the second link member 22 and the cam 23 are disposed between the first tension roller 42 and the second tension roller 43, and are respectively disposed on both the front face's side and the rear face's side of the image forming apparatus 100. The primary transfer roller 34A is supported at shaft thereof by the first link member 21 disposed on the front face's side and the first link member 21 disposed on the rear face's side. The primary transfer rollers 34B through 34D are supported at shafts thereof by the second link member 22 disposed on the front face's side and the second link member 22 disposed on the rear face's side.

The cam 23 on the front face's side and the cam 23 on the rear face's side are fixed on a single cam shaft 231, and revolve around the cam shaft 231 in equiphase to each other. The cam shaft 231 is caused to revolve by a motive power transmitted from a drive source 232. For example, for the drive source 232, a stepping motor is used.

Figure 5A:
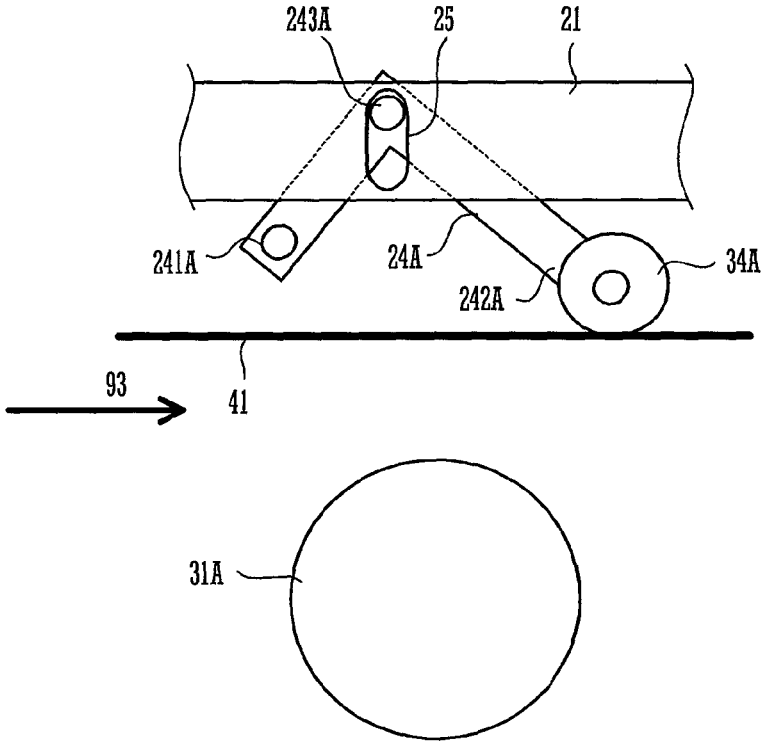
FIG. 5A and FIG. 5B are enlarged partial views of the transfer device, with FIG. 5A showing a state of the primary transfer roller at a separate position, and FIG. 5B showing a state of the primary transfer roller at a pressing position.
Figure 5B:
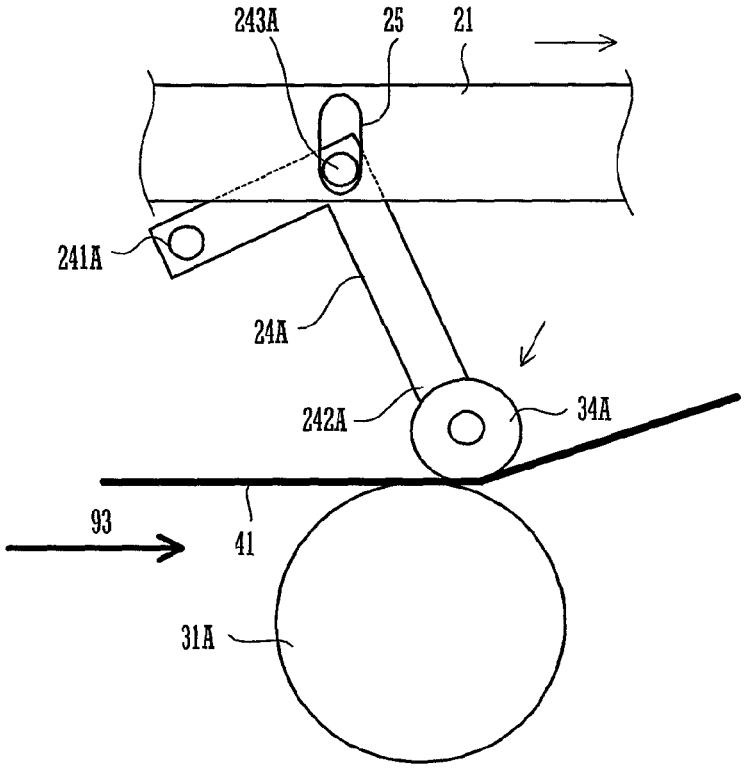

As shown in FIG. 5A and FIG. 5B, the first to fourth swinging members 24A through 24D each take a bent shape in L-character. The second to fourth swinging members 24B through 24D are configured in the same manner as the first swinging member 24A except for the direction of installation to the second link member 22 in the direction of movement 93. The second to fourth swinging members 24B through 24D are installed in bilateral symmetry with the first swinging member 24A in FIG. 2A.

Figure 3B:
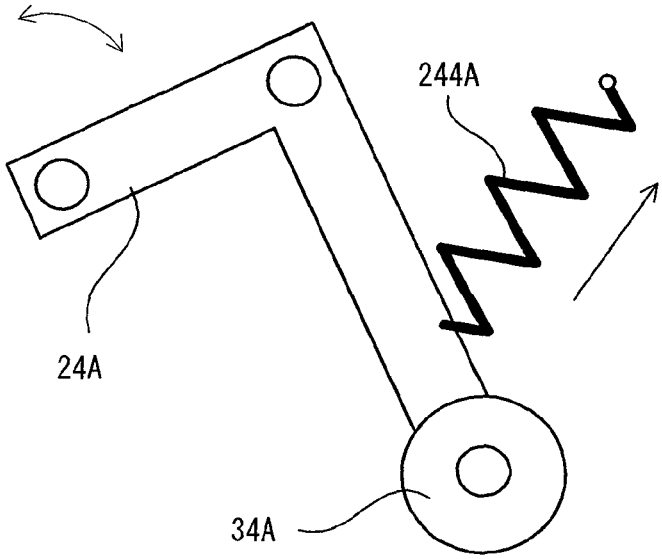
FIG. 3B is a drawing showing a configuration of a primary transfer roller.

A first end portion 241A of the first swinging member 24A is rotatably supported by a frame, which is not shown, of the intermediate transfer unit 40 on the photoreceptor drum 31A's side than the first link member 21. A second end portion 242A of the first swinging member 24A rotatably supports the primary transfer roller 34A. Likewise, respective first end portions of the second to fourth swinging members 24B through 24D are rotatably supported by the frame, which is not shown, of the intermediate transfer unit 40 on the photoreceptor drums 31B's through 31D's sides than the second link member 22. Respective second end portions of the second to fourth swinging members 24B through 24D rotatably support the primary transfer rollers 34B through 34D. As shown in FIG. 3B, the first swinging member 24A is urged by a spring 244A toward a direction separating from the photoreceptor drum 31A. Similarly, the second to fourth swinging members 24B through 24D are respectively urged by springs toward directions separating from the photoreceptor drums 31B through 31D. Here, in FIG. 5A and FIG. 5B, indication of the spring 244A is omitted.

The first link member 21 has a slit 25 that is long in a direction perpendicular to the direction of movement 93 at a position corresponding to the first swinging member 24A. The second link member 22 has slits that are long in the direction perpendicular to the direction of movement 93 at positions corresponding to the respective second to fourth swinging members 24B through 24D.

The first swinging member 24A has at its bent portion a protruding section 243A projecting in the direction of the rotating shaft of the primary transfer roller 34A. The protruding section 243A is displaced in the slit 25 of the first link member 21 along the longitudinal direction of the slit 25.

Protruding sections of the second to fourth swinging members 24B through 24D are displaced in respective slits of the second link member 22 along the longitudinal direction of the respective slits.

Therefore, as shown in FIG. 5B, when the first link member 21 moves toward a direction separating from the cam shaft 231, that is to say, toward the downstream side in the direction of movement 93 of the intermediate transfer belt 41, the protruding section 243A moves downward in the slit 25 against an elastic force of the spring 244A; thus the primary transfer roller 34A descends and is displaced to the pressing position. This causes the intermediate transfer belt 41 to be pressed against the photoreceptor drum 31A. On the other hand, as shown in FIG. 5A, when the first link member 21 moves toward a direction approaching the cam shaft 231, that is to say, toward the upstream side in the direction of movement 93, the protruding section 243A moves upward in the slit 25 with the elastic force of the spring 244A; thus the primary transfer roller 34A ascends and is displaced to the separate position. This causes the intermediate transfer belt 41 to be separate from the photoreceptor drum 31A.

Likewise, when the second link member 22 moves toward a direction separating from the cam shaft 231, that is to say, toward the upstream side in the direction of movement 93, the primary transfer rollers 34B through 34D descend and move to the respective pressing positions; and when the second link member 22 moves toward a direction approaching the cam shaft 231, that is to say, toward the downstream side in the direction of movement 93, the primary transfer rollers 34B through 34D ascend and move to the respective separate positions.

Figure 6A:
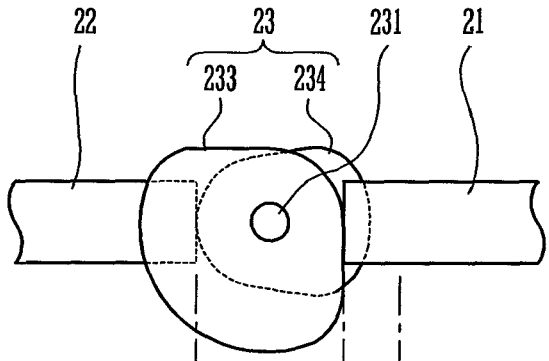
FIG. 6A through FIG. 6C are drawings showing a structure of a cam and a state of an arrangement thereof, with FIG. 6A showing a state thereof in non-image forming, FIG. 6B showing a state thereof in monochromatic image forming, and FIG. 6C showing a state thereof in full-color image forming.
Figure 6B:
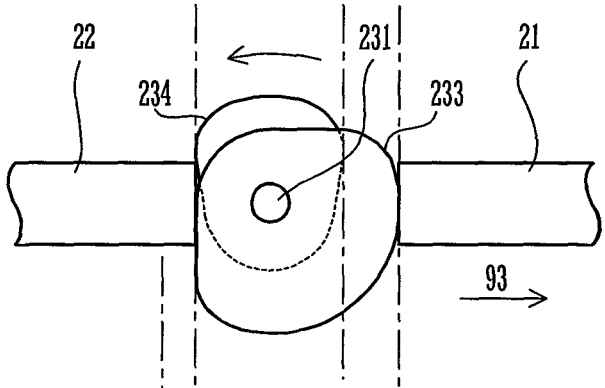
Figure 6C:
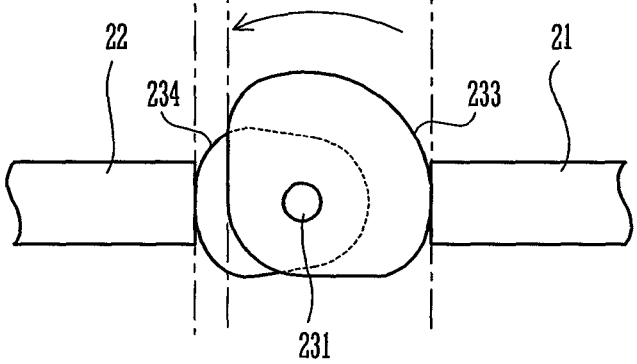

As shown in FIG. 6A through FIG. 6C, the cam 23 includes a first cam section 233 and a second cam section 234. The first cam section 233 and the second cam section 234 are fixed on the cam shaft 231 at positions shifted from one another along the cam shaft 231, and revolve around the cam shaft 231. The first link member 21 is in contact with a circumferential working surface of the first cam section 233 with pressure. The second link member 22 is in contact with a circumferential working surface of the second cam section 234 with pressure. The first cam section 233 and the second cam section 234 respectively consist of eccentric cams.

As shown in FIG. 6A, in non-image forming, the cam 23 is disposed at a predetermined first angle. This causes both of the first link member 21 and the second link member 22 to approach the cam shaft 231. As a result, all the primary transfer rollers 34A through 34D are disposed at the separate positions, thereby causing the intermediate transfer belt 41 to be separate from all the photoreceptor drums 31A through 31D.

As shown in FIG. 6B, in monochromatic image forming, the cam 23 is disposed at a predetermined second angle revolved by 90 degrees counterclockwise in FIG. 6B with respect to the state of non-image forming, that is to say, the first angle. This causes the first link member 21 to separate from the cam shaft 231, and the second link member 22 to approach the cam shaft 231. As a result, the primary transfer roller for monochrome 34A is displaced to the pressing position, thereby causing the intermediate transfer belt 41 to be pressed against the photoreceptor drum 31A.

On the other hand, the primary transfer rollers 34B through 34D for color are disposed at the separate positions, thereby causing the intermediate transfer belt 41 to be separate from the photoreceptor drums for color 31A through 31D.

As shown in FIG. 6C, in full-color image forming, the cam 23 is disposed at a predetermined third angle revolved by 180 degrees counterclockwise in FIG. 6C with respect to the state of non-image forming, that is to say, the first angle. This causes both of the first link member 21 and the second link member 22 to separate from the cam shaft 231. As a result, all the primary transfer rollers 34A through 34D are disposed at the pressing positions, thereby causing the intermediate transfer belt 41 to be pressed against all the photoreceptor drums 31A through 31D.

Figure 7A:
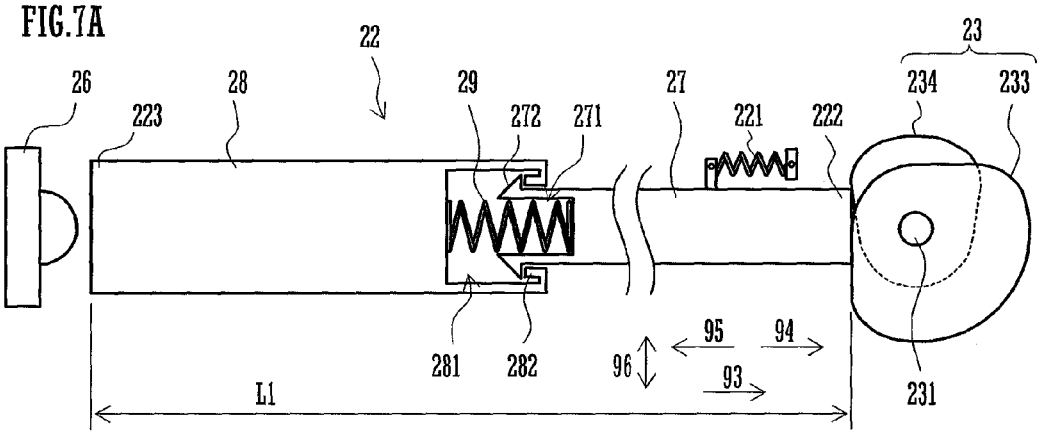
FIG. 7A through FIG. 7C are drawings showing a cross sectional structure of a link member for color and a movement thereof when it moves toward a second direction.
Figure 7B:
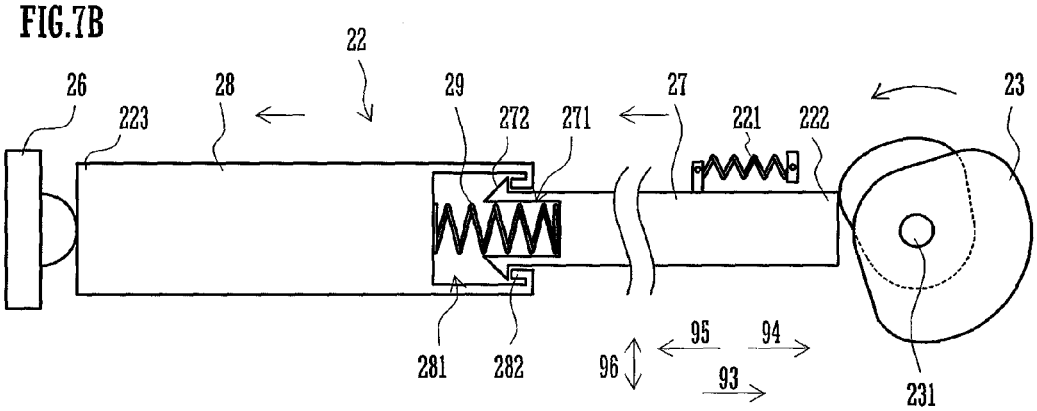
Figure 7C:
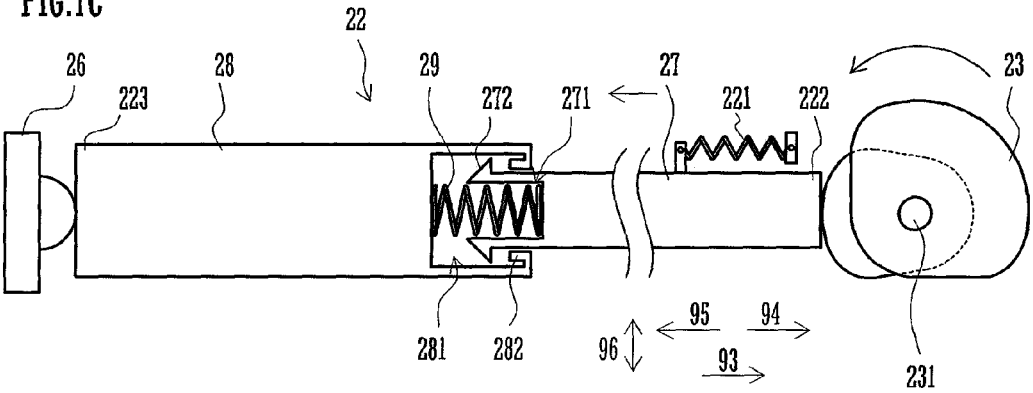

As shown in FIG. 7A through FIG. 7C, a regulatory member 26 is disposed on the opposite side of the cam 23 with respect to the second link member 22 along the direction of movement 93. That is to say, the second link member 22 is disposed between the cam 23 and the regulatory member 26 along the direction of movement 93. The second link member 22 is configured movable within a predetermined range in a first direction 94 approaching the cam 23's side along the direction of movement 93 and in a second direction 95 approaching the regulatory member 26's side, i.e. the direction opposite to the first direction 94. In the state where the cam 23 is disposed at the first angle for non-image forming, a predetermined gap is provided between the second link member 22 and the regulatory member 26.

The regulatory member 26 restrains the second link member 22 from moving further than a predetermined position toward the second direction 95. An abutment section of the regulatory member 26 with the second link member 22 gives a hemispheric shape projecting toward the second link member 22's side.

The second link member 22 is split into a plurality of link arms along the direction of movement 93. In the embodiment, the second link member 22 is divided into two parts, that is to say, a first link arm 27 disposed on the cam 23's side and a second link arm 28 disposed on the regulatory member 26's side. The second link member 22 includes an elastic member 29, in addition to the first link arm 27 and the second link arm 28. As an example, the second swinging member 24B and the third swinging member 24C are joined to the first link arm 27, and the fourth swinging member 24C is joined to the second link arm 28. As an example, the second link member 22 is made of resin such as POM resin or the like.

The first link arm 27 has a receiver section 271 receiving the elastic member 29 at a first joint end portion on the upstream side of the first direction 94. As an example, the receiver section 271 is formed into a concavity opening toward the upstream side of the first direction 94. Also, the first link arm 27 has at the first joint end portion thereof a first locking section 272 protruding along width directions 96 perpendicular to the longitudinal direction of the second link member 22. As an example, the first locking section 272 is provided at an edge portion of an outside face of the receiver section 271.

The second link arm 28 has, at the second joint end portion thereof on the downstream side of the first direction 94, a housing section 281 containing the elastic member 29. The housing section 281 is formed into a concavity opening toward the downstream side of the first direction 94, and is configured in such a manner that the first joint end portion of the first link arm 27 can be inserted in and removed from the housing section 281. In this manner, each joint portion of the two adjacent link arms 27, 28 is configured in such a manner that an overall length L1 of the two adjacent link arms 27, 28 is variable within a range that is not less than a predetermined minimum value and not greater than a predetermined maximum value.

Further, the second link arm 28 has a second locking section 282 that protrudes along width directions 96 at the second joint end portion and that is capable of engagement with the first locking section 272. As an example, the second locking section 282 is provided at an edge portion of an inside face of the housing section 281.

When the first joint end portion of the first link arm 27 is inserted in the housing section 281 of the second link arm 28, and when the first locking section 272 is disposed on the upstream side of the first direction 94 than the second locking section 282, the first and second locking sections 272, 282's engagement with each other makes it impossible for the first locking section 272 to move to the downstream side of the direction 94 further than the second locking section 282.

The first locking section 272 and the second locking section 282 constitute an engagement mechanism that causes the first link arm 27 and the second link arm 28 to engage with each other in order for the overall length L1 of the two adjacent link arms 27, 28 not to get longer beyond the predetermined maximum value.

The elastic member 29 is disposed between the first link arm 27 and the second link arm 28, and exerts an urging force toward a direction to which the overall length L1 of the two adjacent link arms 27, 28 gets longer. For example, for the elastic member 29, a coiled spring is used. Also, for the elastic member 29, a damper containing a liquid enclosed in a tubular cylinder can be used.

The elastic member 29 is contained in the housing section 281 of the second link member 28. One end portion of the elastic member 29 is locked to the housing section 281, and the other end portion is locked to the receiver section 271 of the first link member 27.

The elastic member 29 is configured so as to cause the second link arm 28 to follow the first link arm 27 until the second link arm 28 comes into contact with the regulatory member when the second link member 22 moves toward the second direction 95, and so as to allow the overall length L1 of the two adjacent link arms 27, 28 to shorten against the urging force of the elastic member 29 as the second link member 22 moves toward the second direction 95 after the second link arm 28 has come into contact with the regulatory member 26. In the embodiment, a coiled spring having a spring constant acting as described above is employed for the elastic member 29.

As shown in FIG. 7A, the second link member 22 is urged toward the cam 23's side by a spring 221. The second link member 22, with its cam's side end portion 222 in contact with a circumferential working surface of the cam 23 with pressure acting as a point of reference for positioning, moves along the direction of movement 93 as the cam 23 revolves.

As shown in FIG. 7B, when the second link member 22 moves toward the second direction 95, a regulatory member's side end portion 223 on the opposite side of the cam's side end portion 222 of the second link member 22, after coming into contact with the regulatory member 26, also functions as a point of reference for positioning.

After the regulatory member's side end portion 223 have come into contact with the regulatory member 26, the second link member 22 shortens against the urging force of the elastic member 29 as the second link member 22 moves toward the second direction 95, thereby causing the overall length L1 to shorten.

As shown in FIG. 7C, in the state where the cam 23 has revolved to the third angle at which the second link member 22 is caused to be most separate from the cam shaft 231, the overall length L1 of the two adjacent link arms 27, 28 takes a value other than the minimum value and the maximum value of the overall length L1 of the second link member 22. That is to say, in the state where the cam 23 has revolved to the third angle at which the second link member 22 is caused to be most separate from the cam shaft 231, a gap is provided between the first locking section 272 and the second locking section 282, and a gap is also provided between an end portion of the housing section 281 on the upstream side of the first direction 94 and the end portion of the first link arm 27 on the upstream side of the first direction 94. The third angle corresponds to the separation angle.

Therefore, even when the second link member 22 is subjected to thermal expansion or thermal shrinkage, influence of the thermally induced dimensional change on the second link member 22 is absorbed by the elastic member 29; and hence the position of the regulatory member's side end portion 223 in the state where the cam 23 has revolved to the third angle is maintained at a position of contact with the regulatory member 26, i.e., at a constant position, regardless of the thermally induced dimensional change of the second link member 22. In this manner, both of the cam's side end portion 222 and the regulatory member's side end portion 223 of the link member 22 function as points of reference for positioning. Accordingly, deterioration of accuracy in the arrangement of the primary transfer roller 34B through 34D is suppressed. In addition, this also allows for suppressing inclination of the primary transfer rollers 34B through 34D with respect to the direction perpendicular to the direction of movement 93 due to a difference in the degree of the thermally induced dimensional change between the second link member 22 disposed on the front face's side and the second link member 22 disposed on the rear face's side. In particular, the effect of suppression of the deterioration of accuracy in the arrangement increases at the primary transfer roller 34D that is joined to the second link member 22 at a position distant from the cam 23.

In this manner, increasing the accuracy in the arrangement of the primary transfer roller 34B through 34D makes it possible to stabilize the movement of the intermediate transfer belt 41's contact with and separation from the photoreceptor drums 31B through 31D. As a result, even when the second link member 22 is subjected to thermal expansion, the contact pressure of the intermediate transfer belt 41 against the photoreceptor drums for color 31B through 31D is prevented from becoming too strong, thereby suppressing the shortening of the life cycle of the photoreceptor drums 31B through 31D as well as the intermediate transfer belt 41 due to hastened abrasions thereof. Also, even when the second link member 22 is subjected to thermal shrinkage, occurrence of a situation in which the intermediate transfer belt 41 will not come into contact with the photoreceptor drums 31B through 31D is suppressed, thereby suppressing deterioration of picture quality.

Figure 8A:
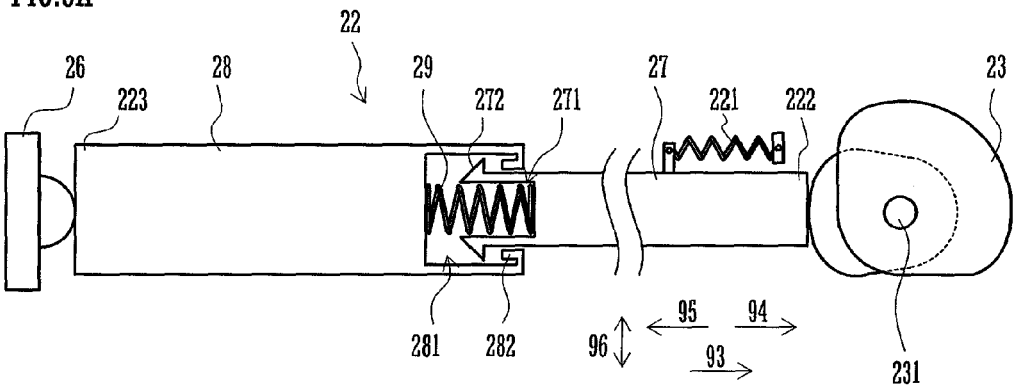
FIG. 8A through FIG. 8C are drawings showing the cross sectional structure of the link member for color and a movement thereof when it moves toward a first direction.
Figure 8B:
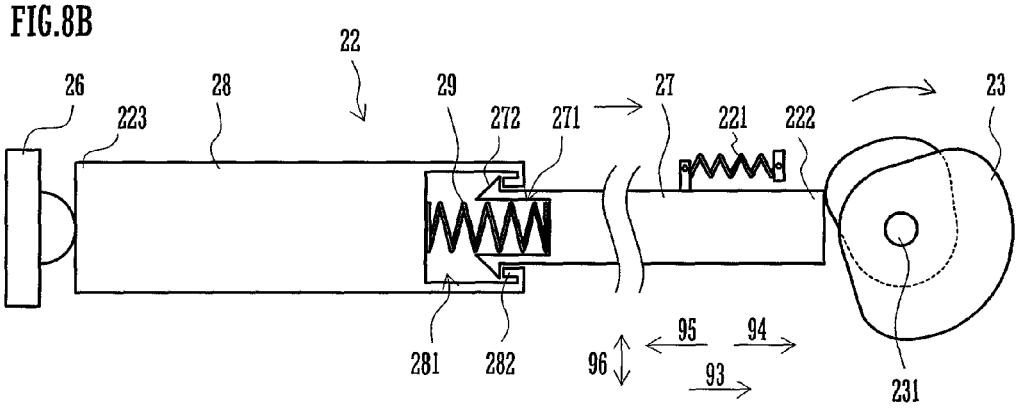
Figure 8C:
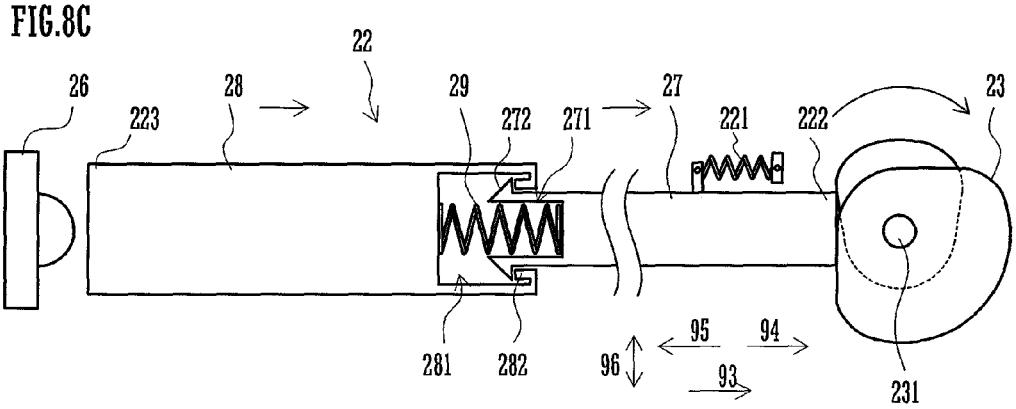

Moreover, from the state where the overall length L1 of the first link arm 27 and the second link arm 28 is shorter than the maximum value as shown in FIG. 8A, when the cam 23 revolves clockwise in FIG. 8B as shown in FIG. 8B, first, the first link arm 27 is caused to move toward the first direction 94 by the urging force of the elastic member 29; and then, with the first locking section 272 and the second locking section 282 engaging with each other, the second link arm 28 is caused to move toward the first direction 94 following the first link arm 27 as shown in FIG. 8C.

Further, even when the second link member 22 is split into more than two link arms without limiting the split to two, configuring each joint portion of adjacent link arms in a manner similar to the above mentioned embodiment still yields an effect of the capability to suppress the deterioration of accuracy in the arrangement of the primary transfer rollers.

Moreover, although in the above mentioned embodiment the present invention is applied to the second link member 22 that causes the plurality of the primary transfer rollers 34B through 34D to be displaced among the primary transfer rollers 34A through 34D, application of the present invention to the first link member that causes the single primary transfer roller 34A to be displaced also yields an effect of the capability to suppress the deterioration of accuracy in the arrangement of the primary transfer roller 34A.

The above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

What is claimed is:

1. A transfer device that is installed in an image forming apparatus transferring toner images from a plurality of image bearing members onto paper through an intermediate transfer belt and that includes a plurality of primary transfer rollers disposed on the opposite side of the plurality of image bearing members across the intermediate transfer belt and capable of being displaced from a reference position in a contact direction and a separation direction in relation to the respective plurality of image bearing members, the device comprising:

a cam that revolves, receiving transmission of power, around a cam shaft;

a link member which is movable, while being in contact with the cam with pressure, within a predetermined range in a first direction in which the link member moves toward the cam shaft and in a second direction that is the direction opposite to the first direction and of which movement toward the first direction and the second direction causes at least one of the primary transfer rollers to be displaced toward the contact direction and the separation direction; and a regulatory member that restrains the link member from moving further than a predetermined position toward the second direction, wherein the link member is split into a plurality of link arms along the first direction with each joint portion of two adjacent link arms being configured in such a manner that an overall length of the two adjacent link arms is variable within a predetermined range that is not less than a predetermined minimum value and not greater than a predetermined maximum value, each of the joint portions including:

an elastic member biasing the two adjacent link arms toward a direction to which the overall length gets longer in a state where the cam has revolved to a spacing angle at which the link member is caused to be most separate from the cam shaft; and an engagement mechanism that engages the two adjacent link arms with each other in order for the overall length not to get longer beyond the maximum value, wherein the overall length in the state where the cam has revolved to the spacing angle takes a value other than the minimum value and the maximum value.

2. The transfer device as claimed in claim 1 wherein the link member is configured so as to cause the plurality of primary transfer rollers to be displaced toward the contact direction and the separation direction.

3. The transfer device as claimed in claim 1, wherein a first link arm of the two adjacent link arms comprises a first joint end portion at an end portion of the first link arm, the first joint end portion being included in the link member, the first joint end portion comprises:

a first locking section protruding along width directions perpendicular to the first direction, a second link arm of the two adjacent link arms that is disposed upstream in the first direction from the first link arm comprises a second joint end portion at an end portion of the second link arm, the second joint end portion being included in the link member, the second joint end portion comprises:

a housing section that contains the elastic member; and a second locking section that intrudes along the width directions downstream in the first direction from the first locking section and that is capable of engaging with the first locking section, and the first locking section and the second locking section constitutes the engagement mechanism.

4. The transfer device as claimed in claim 1 wherein the elastic member is a coiled spring.

* * * * *